US008061826B2

(12) United States Patent
Lewis et al.

(10) Patent No.: US 8,061,826 B2
(45) Date of Patent: Nov. 22, 2011

(54) METHODS AND DEVICES FOR REMANUFACTURING AN IMAGING CARTRIDGE

(75) Inventors: Lawrence Dale Lewis, Sanford, NC (US); Donald R. Huck, Sanford, NC (US); James R. Williams, Simms, NC (US); Anthony D. Causey, Fuquay-Varina, NC (US); Glenn L. Szabo, Sanford, NC (US); Billy W. Miller, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 765 days.

(21) Appl. No.: 12/183,561

(22) Filed: Jul. 31, 2008

(65) Prior Publication Data

US 2010/0026767 A1 Feb. 4, 2010

(51) Int. Cl.
*B41J 2/175* (2006.01)
*G03G 15/00* (2006.01)

(52) U.S. Cl. ..... 347/86; 399/109

(58) Field of Classification Search ..... 347/86; 399/109
See application file for complete search history.

(56) References Cited

U.S. PATENT DOCUMENTS

| | | | | |
|---|---|---|---|---|
| 6,416,152 | B1 * | 7/2002 | Matsuzaki et al. | 347/86 X |
| 6,588,871 | B2 * | 7/2003 | Studholme et al. | 347/86 X |
| 6,702,427 | B2 * | 3/2004 | Shimizu et al. | 347/86 X |
| 6,824,258 | B2 * | 11/2004 | Yamamoto et al. | 347/86 |
| 6,851,799 | B2 * | 2/2005 | Trafton et al. | 347/86 |
| 6,968,141 | B2 * | 11/2005 | Fujita et al. | 399/109 |
| 6,970,668 | B2 * | 11/2005 | Ueno et al. | 399/109 |
| 7,040,744 | B2 * | 5/2006 | Shinada | 347/86 |
| 7,097,293 | B2 * | 8/2006 | Ichihashi et al. | 347/86 |
| 7,168,797 | B2 * | 1/2007 | Arai et al. | 347/86 |
| 7,222,949 | B2 * | 5/2007 | Ichihashi et al. | 347/86 |
| 7,249,832 | B2 * | 7/2007 | Sakai et al. | 347/86 |

* cited by examiner

*Primary Examiner* — Sandra Brase

(57) ABSTRACT

The present application is directed to methods and devices for remanufacturing imaging cartridges. An installation handle for positioning an electronic circuit on the imaging cartridge includes a first end, and an adhesive is releasably attached to the first end. The installation handle is adapted for positioning an electronic circuit on a surface of the imaging cartridge while the electronic circuit is releasably secured to the installation handle by the adhesive.

24 Claims, 13 Drawing Sheets

METHODS AND DEVICES FOR REMANUFACTURING AN IMAGING CARTRIDGE

BACKGROUND

The present application is directed to manufacturing, remanufacturing, or repairing replaceable imaging components, and more specifically to replacing imaging cartridge electronic circuits.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines, and all-in-one devices. Imaging cartridges, once spent, are unusable for their originally intended purpose. Without a refurbishing process, these cartridges would simply be discarded, even though the cartridge itself may still have potential life. As a result, techniques have been developed specifically to address this issue. These processes may entail, for example, the disassembly of the various structures of the cartridge, replacing ink or toner, cleaning, adjusting or replacing any worn components and reassembling the imaging cartridge.

Some imaging cartridges include an electronic circuit that may be in the form of a printed circuit board (referred to as a "chip"). The electronic circuit may include memory for storing and reporting information about the cartridge and its interface with a particular type of imaging device. During the remanufacturing process, it may be desirable or necessary to replace the electronic circuit to maintain full functionality and reporting capabilities of the imaging cartridge. Replacing the electronic circuit may involve removing the existing electronic circuit in a manner that permits quick and secure installation of the replacement electronic circuit, while maintaining accurate placement of the replacement electronic circuit on the imaging cartridge.

SUMMARY

The present invention is directed to methods and devices for remanufacturing an imaging cartridge. In one embodiment, a device for remanufacturing an imaging cartridge includes an installation handle having a first end, and an adhesive releasably attached to the first end of the installation handle. The installation handle is adapted for positioning an electronic circuit on a surface of the imaging cartridge while the electronic circuit is releasably secured to the installation handle by the adhesive.

In another embodiment, a device for remanufacturing an imaging cartridge includes an installation handle having a first end, an adhesive releasably attached to the first end of the installation handle, and a release liner releasably attached to the adhesive such that the adhesive is positioned between and in contact with both the installation handle and the release liner. The installation handle is adapted for positioning an electronic circuit on a surface of the imaging cartridge while the electronic circuit is releasably secured to the installation handle by the adhesive.

In yet another embodiment, a method for remanufacturing an imaging cartridge includes providing the imaging cartridge, releasably attaching an electronic circuit to an installation handle, using the installation handle to position the electronic circuit on a surface of the imaging cartridge, and securing the electronic circuit to the surface of the imaging cartridge.

In still another embodiment, a method for remanufacturing an imaging cartridge includes providing the imaging cartridge that has an existing electronic circuit secured to a surface of the imaging cartridge, removing the existing electronic circuit, releasably attaching a replacement electronic circuit to an installation handle, using the installation handle to position the replacement electronic circuit on the surface of the imaging cartridge, and securing the replacement electronic circuit to the surface of the imaging cartridge.

DETAILED DESCRIPTION

Figure 1:
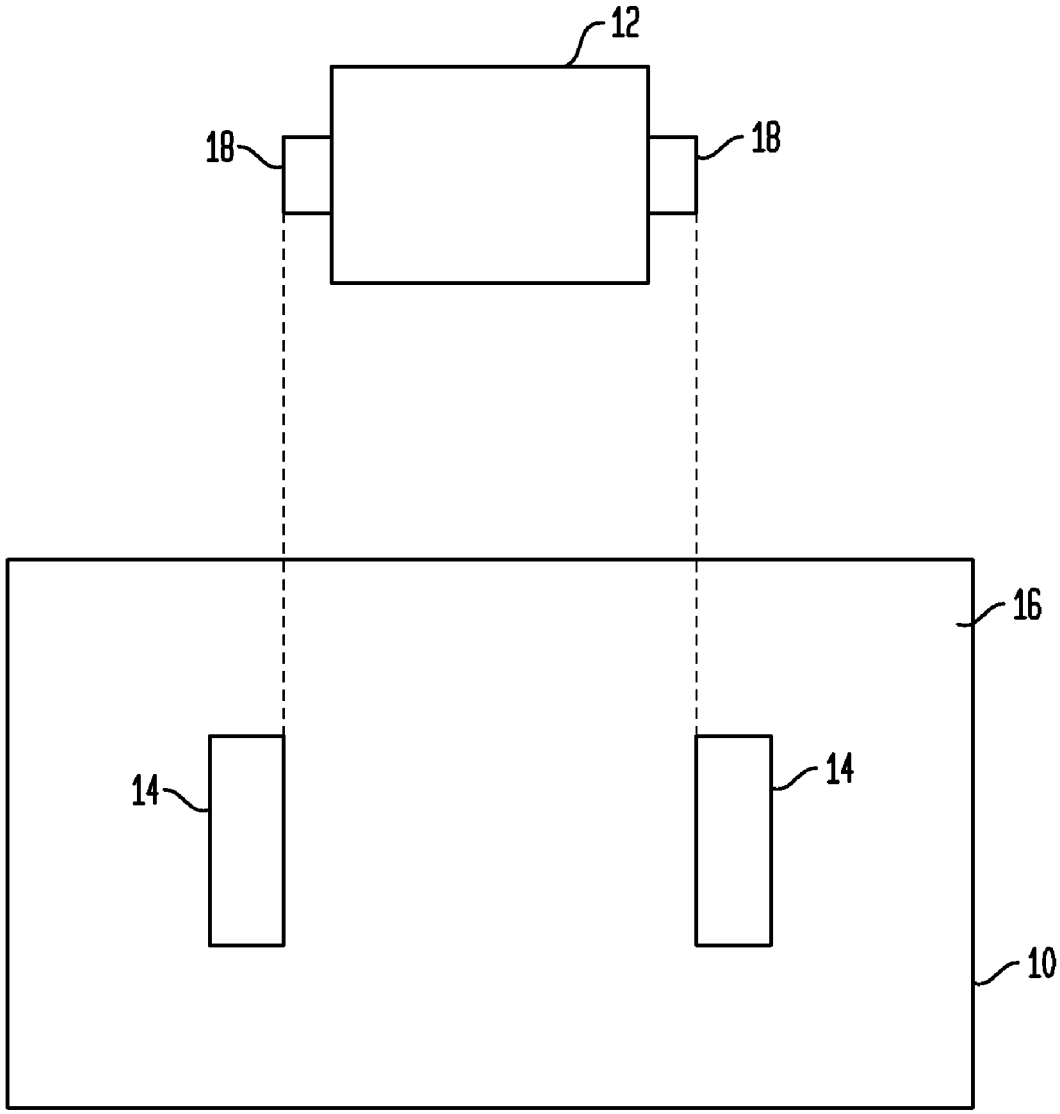
FIG. 1 (PRIOR ART)
FIG. 1 is a schematic view of a prior art imaging cartridge and electronic circuit.

The present application is directed to methods and devices for remanufacturing an imaging cartridge. FIG. 1 schematically illustrates one embodiment of a prior art imaging cartridge 10 and an electronic circuit 12. The imaging cartridge 10 includes one or more engagement features 14 positioned on a surface 16 of the imaging cartridge 10. The electronic circuit 12 includes one or more corresponding engagement features 18. The engagement features 14 of the imaging cartridge 10 interact with the engagement features 18 of the electronic circuit 12. The engagement features 14, 18 may perform a variety of functions, including positioning the electronic circuit 12 on the surface 16 and securing the electronic circuit 12 to the surface 16.

The engagement features 14, 18 may include a variety of configurations. For example, the engagement features 14 of the imaging cartridge 10 may include one or more cylindrical posts extending outward from the surface 16. The corresponding engagement features 18 on the electronic circuit 12 may include holes or slots through which the posts extend. In another example, the engagement features 14 of the imaging cartridge 10 may include opposing L-shaped brackets extending from the surface 16. The corresponding engagement features 18 of the electronic circuit 12 may be side surfaces of the electronic circuit 12 that engage the brackets when the electronic circuit 12 is placed between the brackets.

In any case, during remanufacturing or refurbishing of the imaging cartridge 10, it may be necessary to remove the electronic circuit 12 from the surface 14 of the imaging cartridge 10. The removal process may include removing all or a portion of the engagement features 14 of the imaging cartridge 10. The installation of a replacement electronic circuit 12 may utilize any remaining portion of the engagement feature 14, or may utilize a variety of other installation techniques as detailed below.

Figure 2:
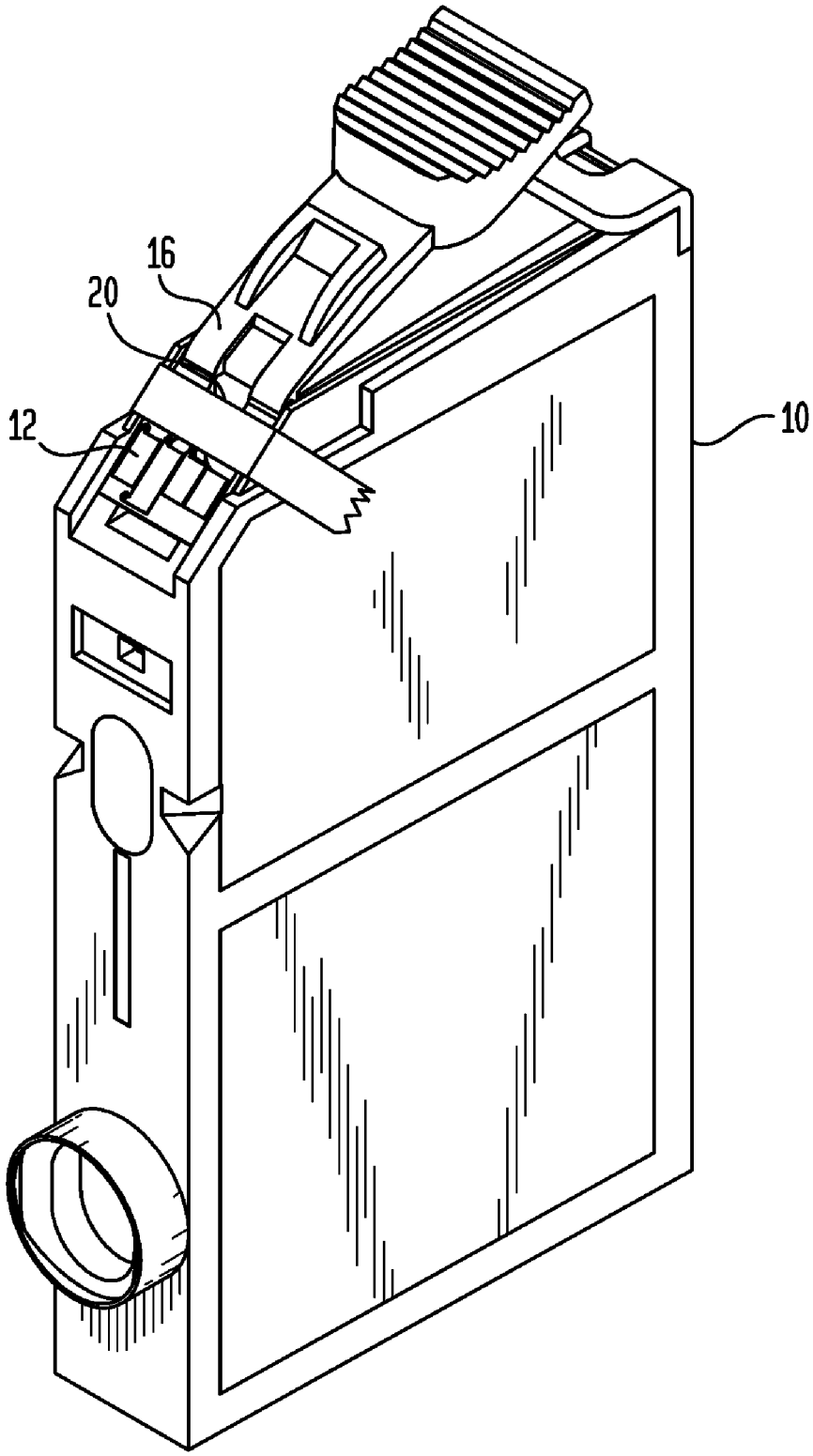
FIG. 2 is a front perspective view of an imaging cartridge and electronic circuit.

FIG. 2 illustrates one embodiment that may be used when the engagement features 14 of the imaging cartridge 10 includes one or more posts, and a portion of the posts remains extending out from the surface 16 of the imaging cartridge 10. The replacement electronic circuit 12 may be placed onto the remaining posts. The electronic circuit 12 may then be secured in place by a variety of devices or methods. In the embodiment illustrated in FIG. 2, a length of adhesive tape 20 is placed across the electronic circuit 12. A portion of the adhesive tape 20 extends onto the imaging cartridge 10. A portion of the adhesive tape 20 may extend onto the imaging cartridge 10 on one or both sides of the electronic circuit 12.

Figure 3:
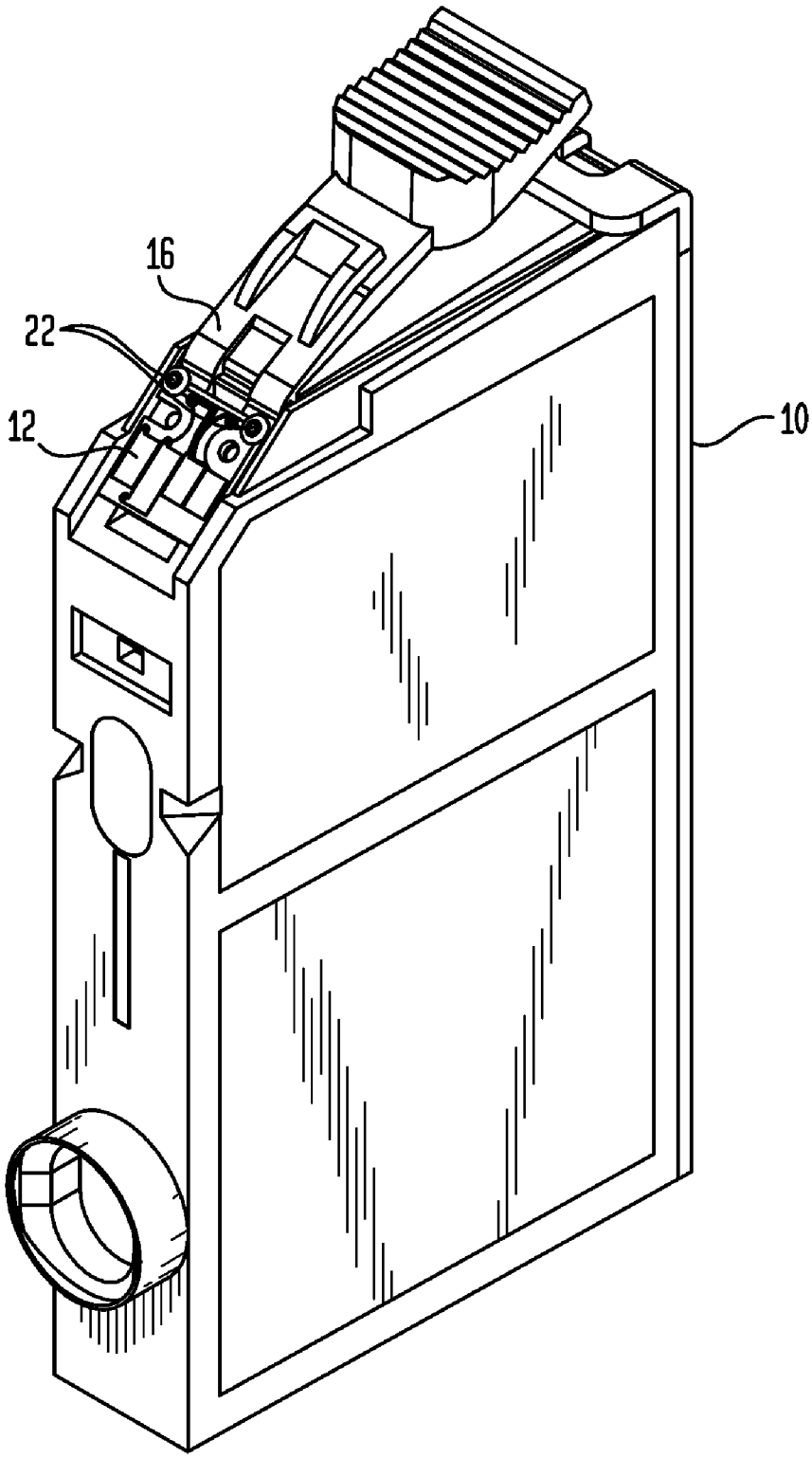
FIG. 3 is a front perspective view of an imaging cartridge and electronic circuit.
Figure 4:
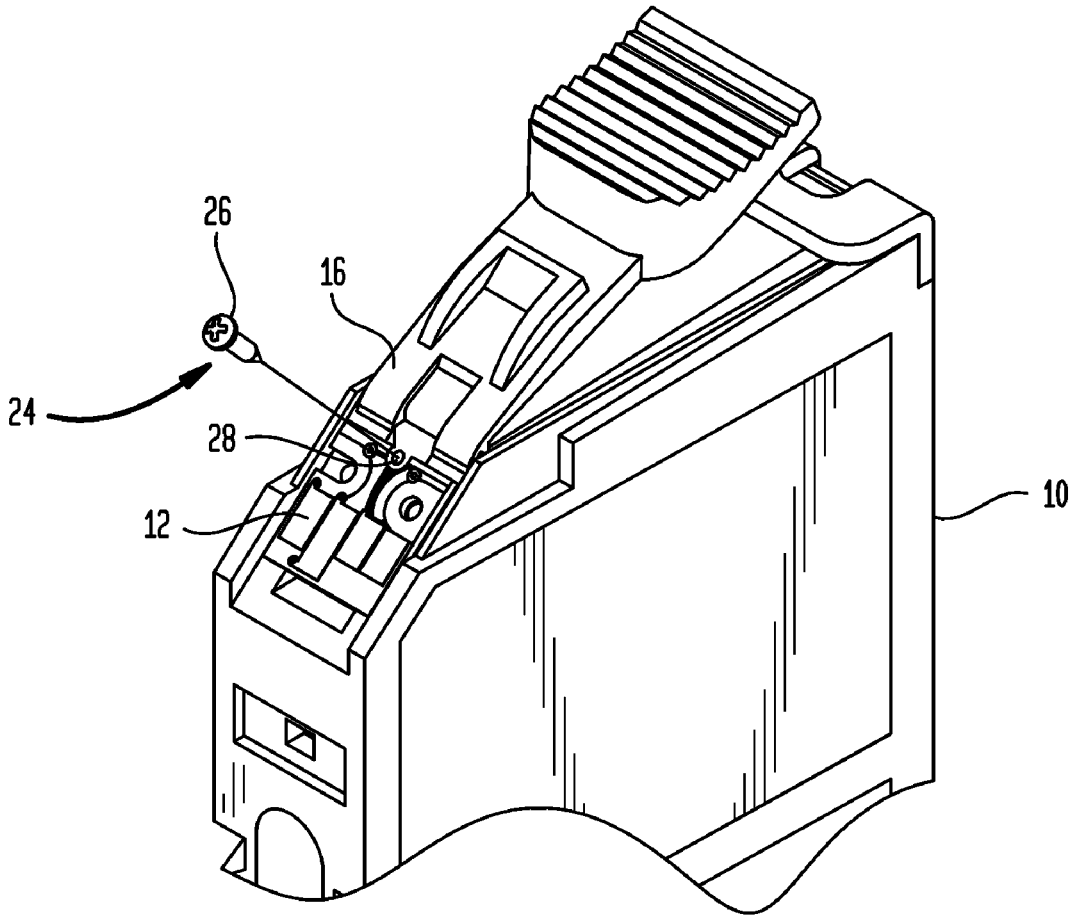
FIG. 4 is a front perspective view of an imaging cartridge and electronic circuit.

A variety of other methods may be used to secure the electronic circuit 12 to the imaging cartridge 10. As illustrated in FIG. 3, a compound 22 may be placed at one or more places along one or more edges of the electronic circuit 12 at the point where the electronic circuit 12 and the imaging cartridge 10 meet. Exemplary compounds 22 include a hot melt adhesive, an epoxy adhesive, thermosetting adhesives, elastomers, thermoplastics, and the like. FIG. 4 illustrates a fastener 24, such as a screw, securing the electronic circuit 12 to the imaging cartridge 10. The fastener 24 may include a head 26 that overlaps a portion of the electronic circuit 12 when the fastener 24 is engaged with the imaging cartridge 10. Alternatively, the fastener 24 may pass through a hole or slot 28 in the electronic circuit 12. Other methods of securing the electronic circuit 12 to the imaging cartridge 10 as are known in the art are intended to fall within the scope of the present invention.

Figure 5:
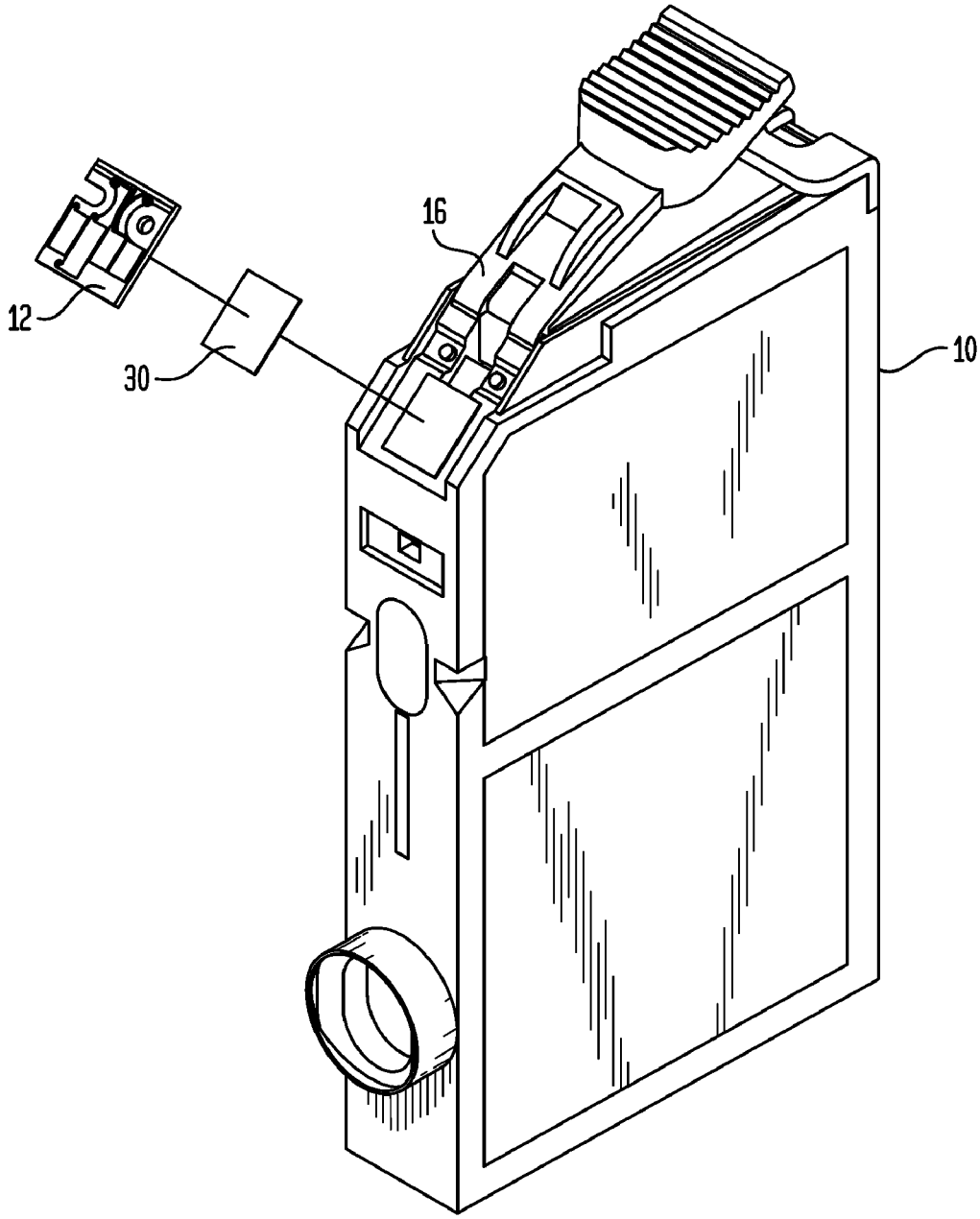
FIG. 5 is a front perspective view of an imaging cartridge and electronic circuit.
Figure 6:
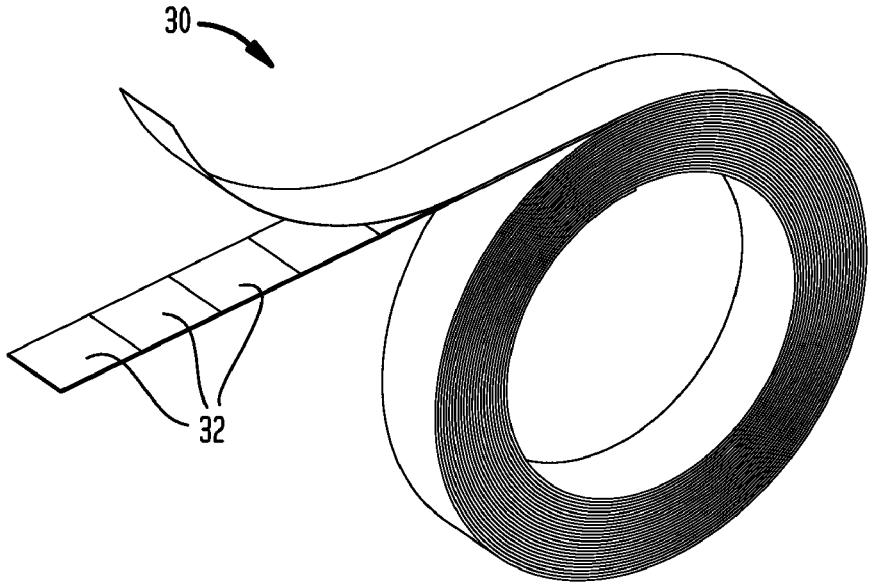
FIG. 6 is a front perspective view of a roll of adhesive.

FIG. 5 illustrates one embodiment in which a layer of double-sided adhesive 30 is placed between the electronic circuit 12 and the surface 16 of the imaging cartridge 10. In one embodiment, the adhesive 30 is a pressure sensitive adhesive. The double-sided adhesive 30 may include a layer of material, such as mylar or other plastic material or a cloth material, sandwiched between layers of adhesive. The primary purpose of this middle layer is to provide structural rigidity to the double-sided adhesive 30. In one embodiment as illustrated in FIG. 6, the double-sided adhesive 30 may be supplied in roll form. Further, the adhesive 30 may be cut or perforated into segments 32 sized for a particular application.

The double-sided adhesive 30 may be first applied to the electronic circuit 12, then the electronic circuit 12 is secured to the imaging cartridge 10. Alternatively, the double-sided adhesive 30 may be first applied to the surface 16 of the imaging cartridge 10. The electronic circuit 12 may then be pressure applied to the exposed side of the double-sided adhesive 30.

The electronic circuit 12 required for some imaging cartridges 10 may be small relative to the hands of a worker required to manually position the electronic circuit 12 on the imaging cartridge 10. Thus, even when the adhesive 30 is supplied in roll form as illustrated in FIG. 6, obtaining a small portion of the adhesive 30 and applying the adhesive 30 to the small electronic circuit 12 may be cumbersome.

Figure 7:
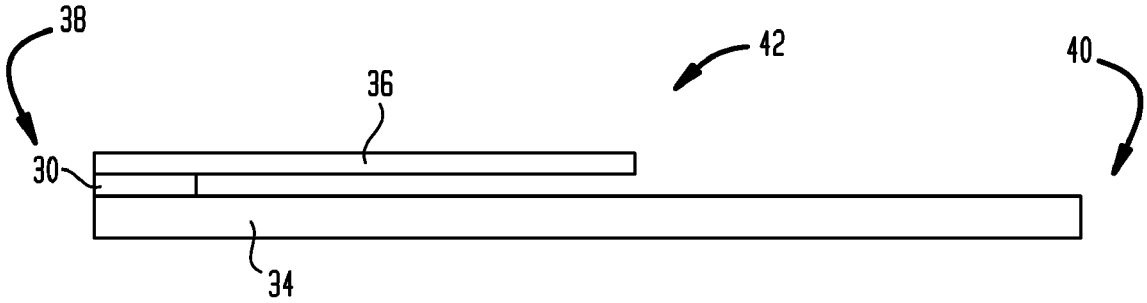
FIG. 7 is side schematic view of an installation handle, adhesive, and release liner.

FIG. 7 illustrates one embodiment of a device 42 to facilitate handling and placement of the adhesive 30. The device 42 comprises an installation handle 34, adhesive 30, and release liner 36. The installation handle 34 may be constructed of, for example, a paper or plastic material having sufficient rigidity such that the installation handle 34 extends generally outward when held at one end. The installation handle 34 comprises a first end 38 adapted to releasably hold the adhesive 30, and a second adhesive-free end 40 adapted to be held by the worker.

The adhesive 30 is positioned at the first end 38 of the installation handle 34. Although FIG. 7 illustrates the adhesive 30 aligned with the first end 38, the adhesive 30 may also be recessed from the first end 38. The adhesive 30 may extend across all or a portion of the width of the installation handle 34.

Positioned on the adhesive 30 opposite the installation handle 34 is the release liner 36. In one embodiment, the release liner 36 is operative to protect the adhesive 30 prior to use. As illustrated in the embodiment of FIG. 7, the release liner 36 extends farther along the installation handle 34 towards the second end 40 than does the adhesive 30. The exact amount that the release liner 36 extends along the installation handle 34 is not critical to the invention. In one embodiment, the length of the release liner 36 is chosen to facilitate removal of the release liner 36 from the device 42. Typically, the width of the release liner 36 is such that the release liner 36 does not allow the adhesive 30 to be exposed. In one embodiment, the width of the release liner 36 is about equal to the width of the installation handle 34. In other embodiments, the width of the release liner 36 is greater than or less than the width of the installation handle.

Figure 8:
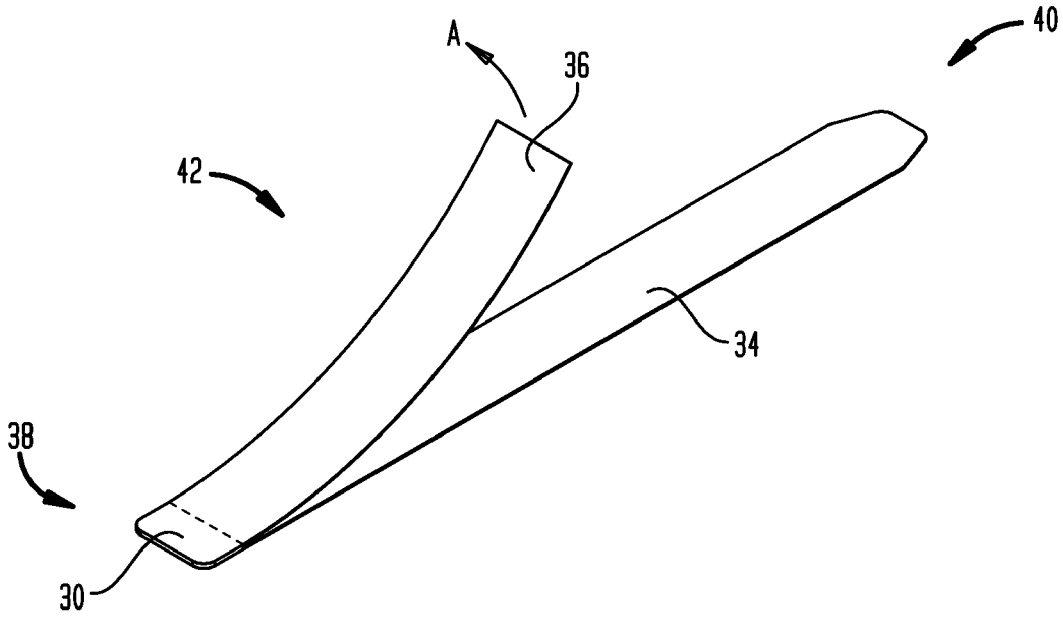
FIG. 8 is a front perspective view of an installation handle, adhesive, and release liner.

The release liner 36 is adapted to releaseably adhere to the adhesive 30. As illustrated in FIG. 8, the worker may grasp the end of the release liner 36 closest to the second end 40 of the installation handle 34 and pull the release liner 36 in the direction of arrow A. This movement may cause the release liner 36 to separate from the adhesive 30, thus exposing the adhesive 30 for use.

In one embodiment, the release liner 36 is constructed of a plastic material. In another embodiment, the release liner is constructed of a paper material. The release liner 36 may, in one embodiment, have a rigidity greater than the rigidity of the installation handle 34. In yet other embodiments, the rigidity of the release liner 36 is equal to or less than the rigidity of the installation handle 34.

Figure 9:
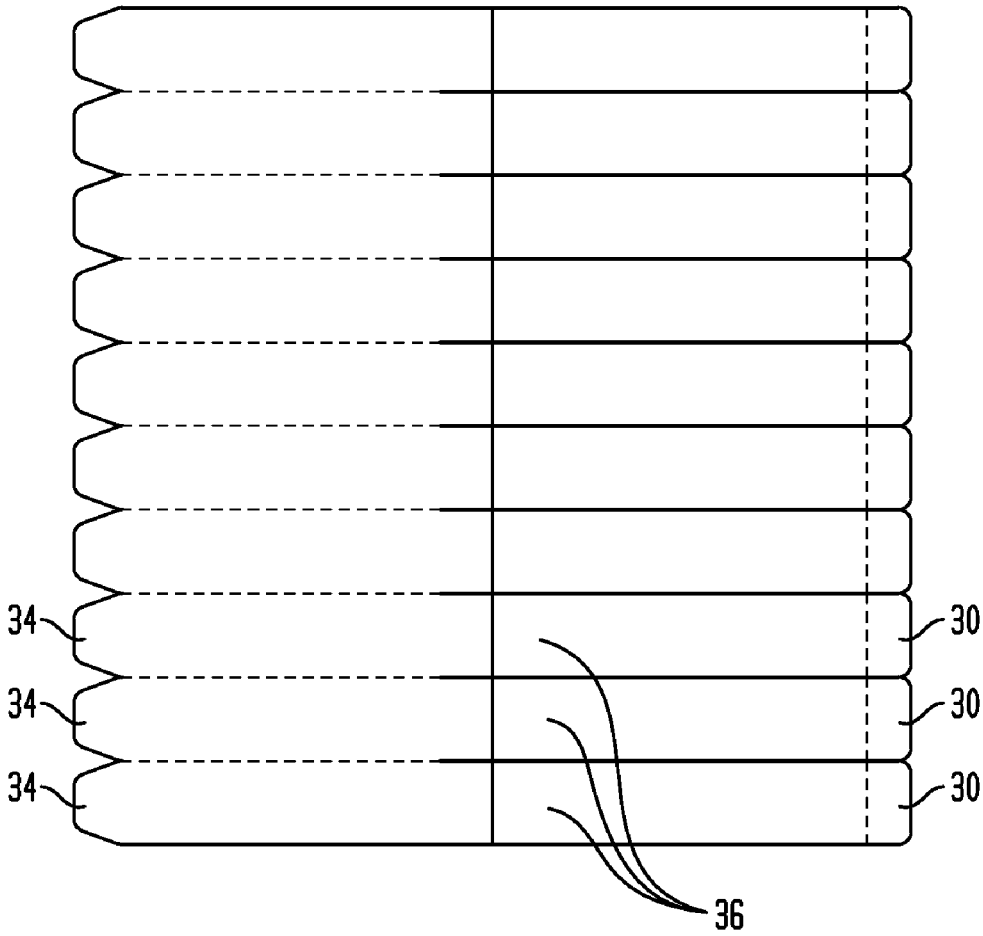
FIG. 9 is a top view of a plurality of installation handles, adhesives, and release liners in a sheet form.

The device 42 may be supplied individually as illustrated in FIG. 8, or in sheet form of a plurality of devices 42 as illustrated in FIG. 9. When supplied in sheet form, the devices 42 may be releaseably attached to one another, such as by a perforation. Alternatively, the devices 42 may be releaseably adhered to a backing material (not shown).

Figure 10:
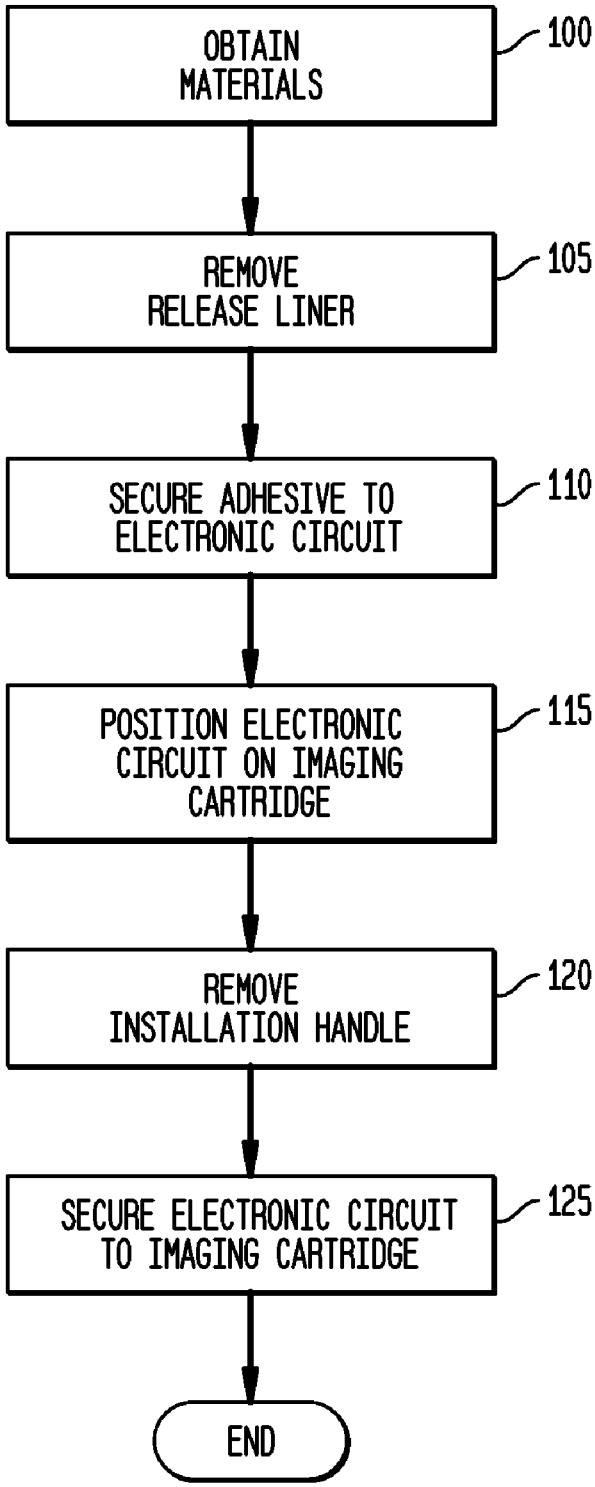
FIG. 10 is a process flow diagram of a method for remanufacturing an imaging cartridge.

FIG. 10 illustrates an exemplary method of using the device 42. First, the worker obtains an imaging cartridge 10, an electronic circuit 12 to be attached to the imaging cartridge 10, and a device 42 (step 100). The worker removes the release liner 36 from the device 42, exposing the adhesive 30 (step 105). Next, the worker positions the exposed adhesive 30 on the proper location of the electronic circuit 12 and presses the adhesive 30 in place on the electronic circuit 12 (step 110). The electronic circuit 12 is now adhered to the adhesive 30 and the installation handle 34. The worker may now use the installation handle 34 to position the electronic circuit 12 on the surface 16 of the imaging cartridge 10 (step 115) (see FIG. 11). While holding the electronic circuit 12 in place, the installation handle 34 is removed exposing the adhesive 30 (step 120). The electronic circuit 12 is then pressed into place on the surface 16 of the imaging cartridge 10 (step 125). Although not illustrated in FIG. 10, the method may additionally include removing an existing electronic circuit 12 from the imaging cartridge 10 when the method is used to refurbish or remanufacture the imaging cartridge 10.

Figure 11:
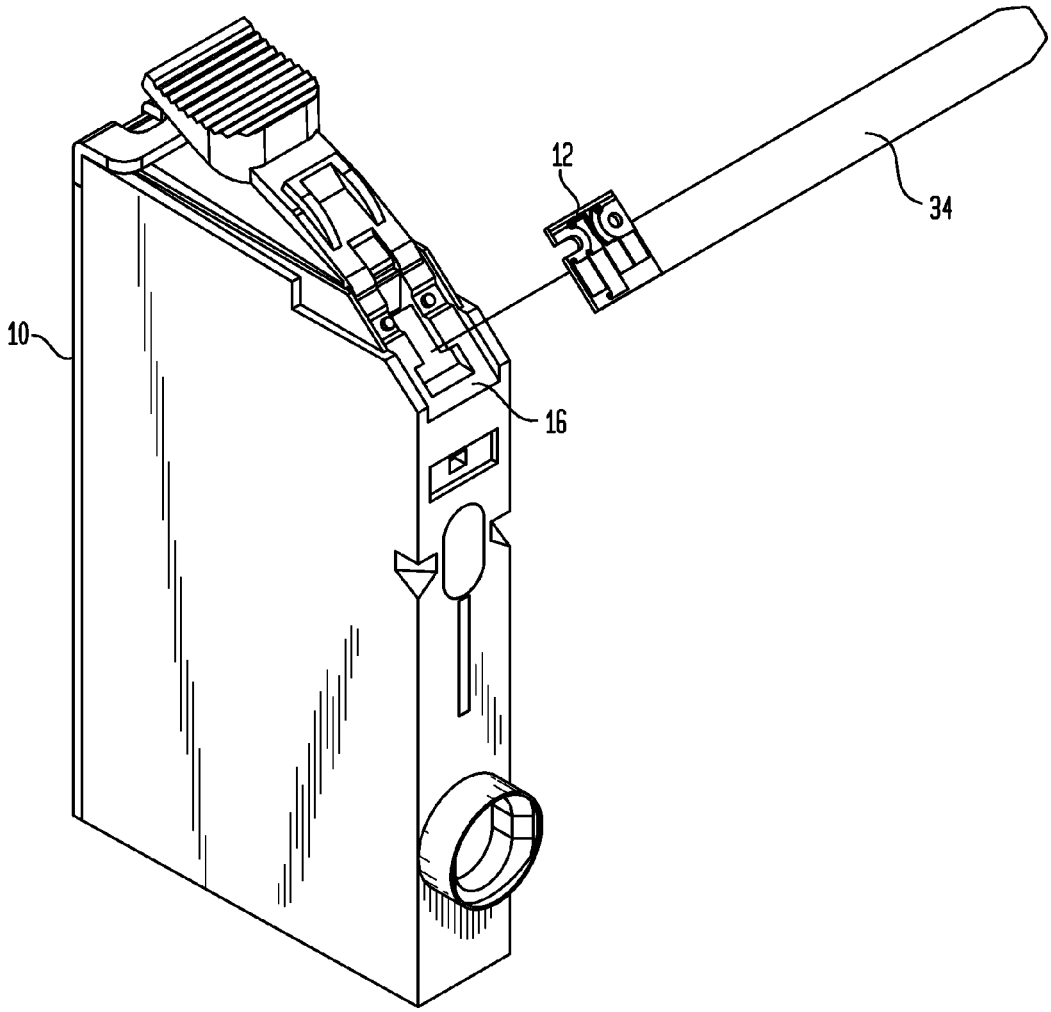
FIG. 11 is a front perspective view of an electronic circuit attached to an installation handle illustrating using the installation handle to position the electronic circuit on the imaging cartridge.

FIG. 11 illustrates the installation handle 34 attached to the electronic circuit 12 in preparation for placing the electronic circuit 12 on the surface 16 of the imaging cartridge 10. As discussed previously, the surface 16 of the imaging cartridge 10 may include posts extending outward from the surface 16 that engage the electronic circuit 12 to properly position the electronic circuit 12. When an existing electronic circuit 12 has been removed from the surface 16, a portion of the posts may remain. The replacement electronic circuit 12 may then be placed on the posts to align the electronic circuit 12. In some instances, the posts may be essentially completely removed along with the existing electronic circuit 12. In this case, more than one installation handle 34 (not shown) may be attached to the electronic circuit 12 to provide additional adhesive on the electronic circuit 12.

The adhesive 30 exhibits an adhesive force that adheres the adhesive 30 to nearly any surface the adhesive 30 contacts. The selection of the adhesive 30 and the material of construction of the installation handle 34 and the release liner 36 typically takes adhesive force into account. For example, the adhesive force between the adhesive 30 and the release liner 36 may be less than the adhesive force between the adhesive 30 and the installation handle 34. This difference in adhesive force may allow the adhesive 30 to remain on the installation handle 34 when the release liner 36 is removed. Similarly, the adhesive force between the adhesive 30 and the installation handle 34 may be less than the adhesive force between the adhesive and the electronic circuit 12. This difference in adhesive force may allow the adhesive 30 to remain on the electronic circuit 12 when the installation handle 34 is removed.

The exact dimensions of the installation handle 34, adhesive 30, and release liner 36 typically depend upon the size and/or configuration of the electronic circuit 12, and to some extend on the shape of the surface 16 of the imaging cartridge 10. In one embodiment, the length of the installation handle 34 is about 2 inches, and the width is about 0.2 inch. The adhesive 30 has a length of about 0.1 inch and a width of about 0.2 inch. The length of the release liner 36 is about 1.0 inch, with a width of about 0.2 inch. Other dimensions of the installation handle 34, adhesive 30, and release liner 36 are also contemplated.

Figure 12:
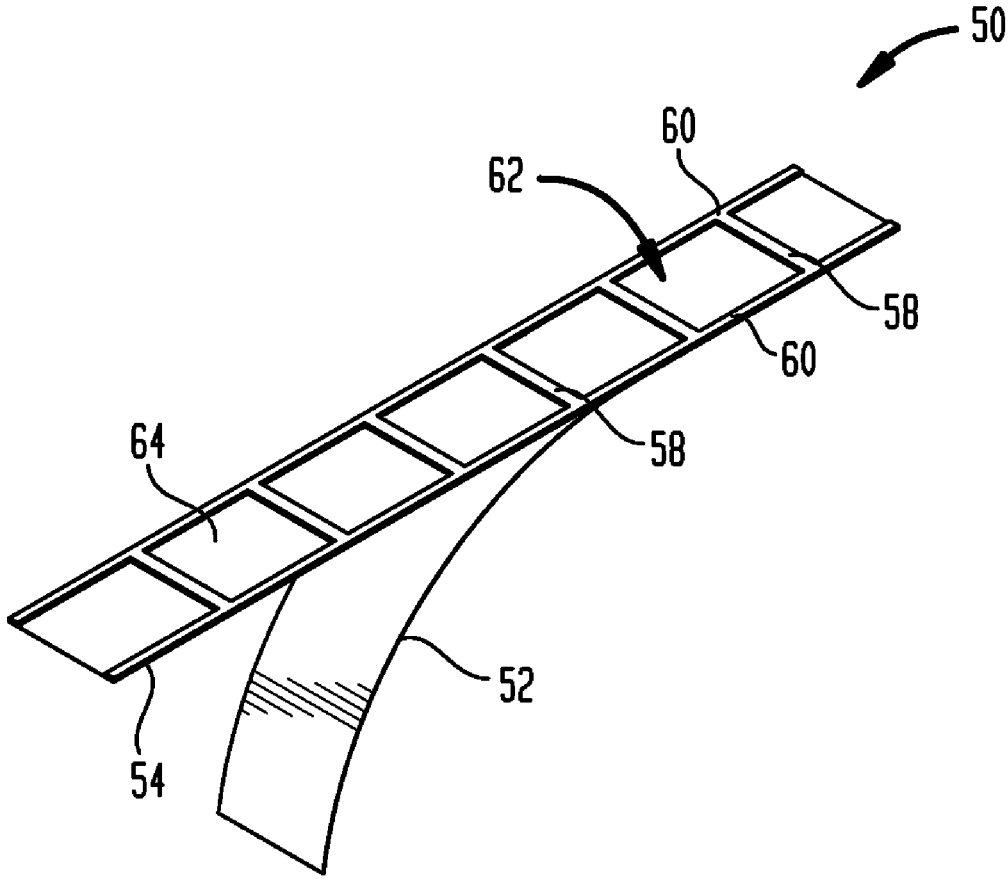
FIG. 12 is a front perspective view of a mounting frame.

FIG. 12 illustrates an embodiment of a mounting frame 50 adapted to attach an electronic circuit 12 to the surface 16 of an imaging cartridge 10. The mounting frame 50 comprises outer side walls 60 and inner side walls 58. The outer side walls 60 and inner side walls 58 are arranged to form an indenture 62 there between. In one embodiment, the indenture 62 is sized to accommodate the electronic circuit 12 within the indenture 62. The mounting frame 50 may also include an adhesive layer 54 on a lower side of the mounting frame 50 to adhere the mounting frame 50 to the imaging device 10. The mounting frame 50 may additionally include a protective release sheet 52 over the adhesive layer 54.

In one embodiment, the mounting frame 50 includes a base member 64 that at least partially spans the indenture 62 between the outer side walls 60 and inner side walls 58. The base member 64 provides a surface onto which the electronic circuit 12 may be mounted, either prior to attaching the mounting frame 50 to the imaging cartridge 10, or after attaching the mounting frame 50 to the imaging cartridge 10. Additionally, the base member 64 may include an adhesive 30 (not shown) to secure the electronic circuit 12 to the base member 64.

Figure 13:
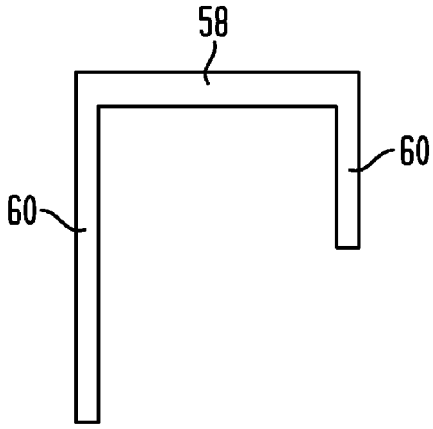
FIG. 13 is a schematic view of a mounting frame.
Figure 14:
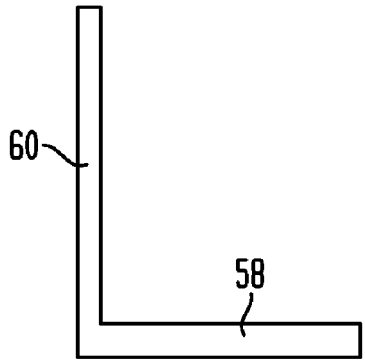
FIG. 14 is a schematic view of a mounting frame.
Figure 15:
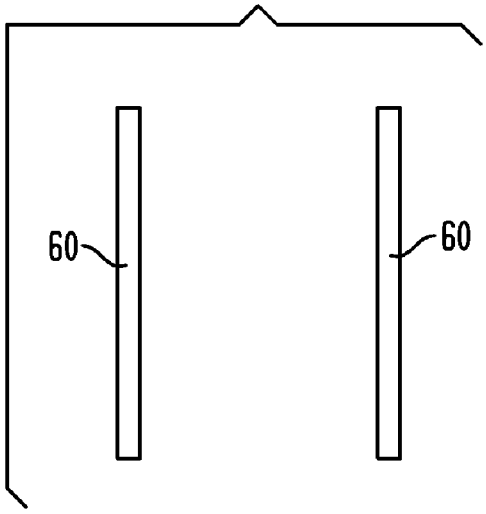
FIG. 15 is a schematic view of a mounting frame.

As illustrated in FIG. 12, each indenture 62 is formed by two outer side walls 60 and two inner side walls 58 arranged in a rectangular shape. Other numbers of outer side walls 60 and inner side walls 58 are also contemplated. For example, FIG. 13 illustrates a mounting frame 50 comprising two outer side walls 60 and one inner side wall 58 arranged in a U-shape. The two outer side walls 60 may have the same or different lengths. FIG. 14 illustrates a mounting frame 50 comprising one outer side wall 60 and one inner side wall 58 arranged in an L-shape. The angle formed by the outer side wall 60 and the inner side wall 58 may be a right angle, or another angle. In another embodiment illustrated in FIG. 15, the mounting frame 50 may comprise two spaced apart outer side walls 60 (or, alternatively, two inner side walls 58).

Figure 16:
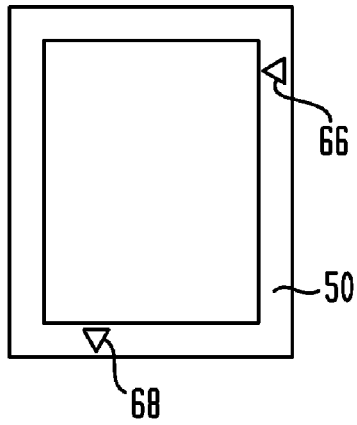
FIG. 16 is a schematic view of a mounting frame including indicia.

When the imaging cartridge 10 is installed in a printer, copier, or other imaging device, the electronic circuit 12 on the imaging cartridge 10 aligns with and typically makes contact with another circuit or electrical contacts within the imaging device. Thus, proper alignment of the electronic circuit 12 on the imaging cartridge may be desirable. FIG. 16 illustrates one embodiment of a mounting frame 50 that includes one or more indicia 66, 68 to aid in alignment. One indicia 66 may be used to align the electronic circuit 12 within the mounting frame 50. Another indicia 68 may be used to align the mounting frame 50 to the imaging cartridge 10.

Figure 17:
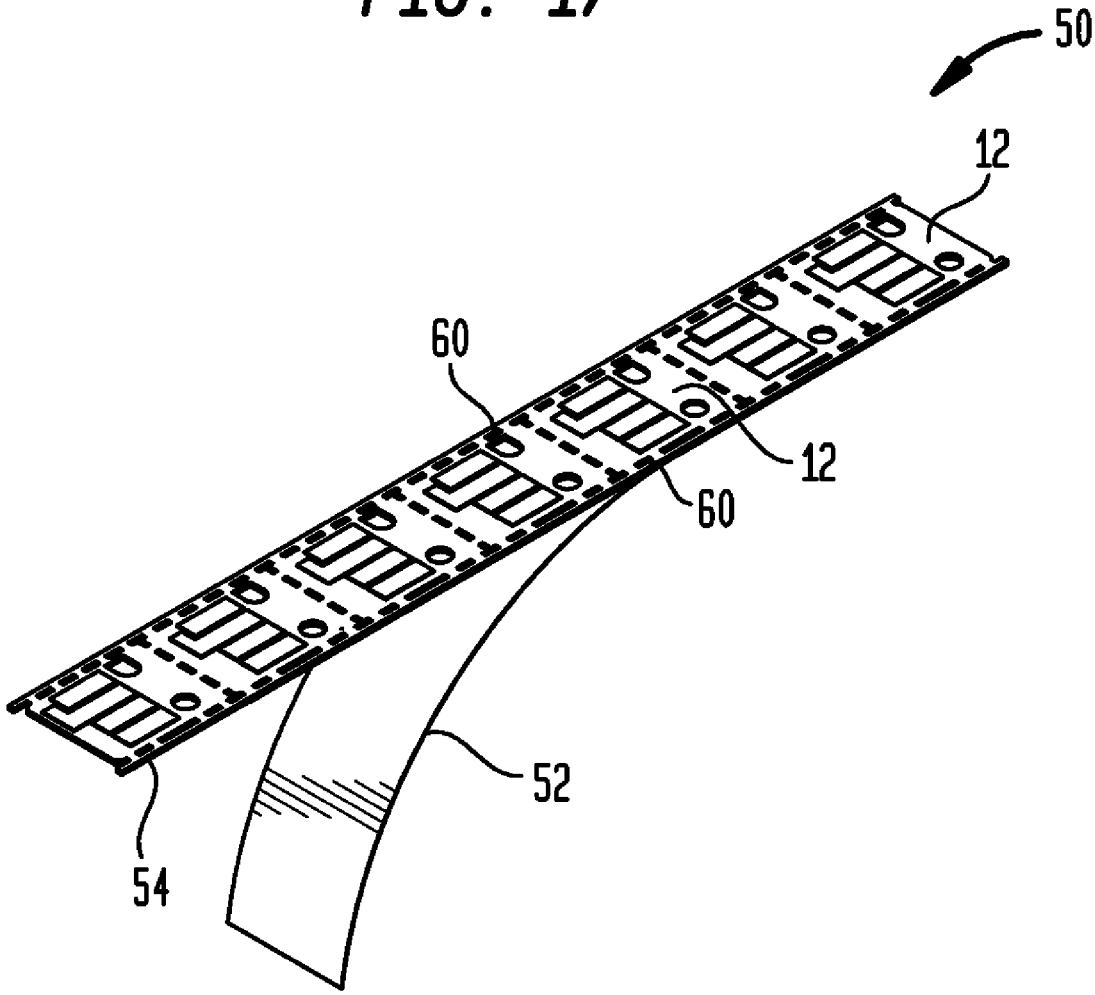
FIG. 17 is front perspective view of a mounting frame including a plurality of electronic circuits.

In one embodiment as illustrated in FIG. 17, the electronic circuit 12 is integrally formed with the mounting frame 50. The mounting frame 50 may include outer side walls 60, and may or may not include inner side walls 58. The mounting frame 50 may also include an adhesive layer 54 on a lower side of the mounting frame 50. The adhesive layer 54 may extend at least partially onto the electronic circuit 12. A protective release sheet 52 may be placed over the adhesive layer 54.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A device for remanufacturing an imaging cartridge, the device comprising:

an installation handle having a first end; and an adhesive releasably attached to the first end of the installation handle;

wherein the installation handle is adapted for positioning an electronic circuit on a surface of the imaging cartridge while the electronic circuit is releasably secured to the installation handle by the adhesive.

2. The device of claim 1, further comprising a release liner releasably attached to the adhesive.

3. The device of claim 2, wherein the release liner extends beyond the adhesive toward a second end of the installation handle, the second end opposite the first end.

4. The device of claim 3, wherein a length of the release liner is less than a length of the installation handle.

5. The device of claim 2, wherein the adhesive is positioned between and in contact with both the installation handle and the release liner.

6. The device of claim 2, wherein the adhesive force between the adhesive and the release liner is less than the adhesive force between the adhesive and the installation handle.

7. The device of claim 2, wherein a width of each of the installation handle, the adhesive, and the release liner are approximately the same.

8. The device of claim 1, wherein the adhesive is a pressure sensitive adhesive.

9. The device of claim 1, wherein the installation handle comprises a second end adapted to be grasped to facilitate positioning the electronic circuit on the surface of the imaging cartridge.

10. The device of claim 1, wherein the adhesive force between the adhesive and the installation handle is less than the adhesive force between the adhesive and the electronic circuit when the electronic circuit is attached to the adhesive.

11. A device for remanufacturing an imaging cartridge, the device comprising:

an installation handle having a first end;

an adhesive releasably attached to the first end of the installation handle; and a release liner releasably attached to the adhesive such that the adhesive is positioned between and in contact with both the installation handle and the release liner;

wherein the installation handle is adapted for positioning an electronic circuit on a surface of the imaging cartridge while the electronic circuit is releasably secured to the installation handle by the adhesive.

12. A method for remanufacturing an imaging cartridge, comprising:

providing the imaging cartridge;

releasably attaching an electronic circuit to an installation handle;

using the installation handle to position the electronic circuit on a surface of the imaging cartridge, and securing the electronic circuit to the surface of the imaging cartridge.

13. The method of claim 12, wherein releasably attaching the electronic circuit to the installation handle comprises releasably attaching the electronic circuit to an adhesive on the installation handle.

14. The method of claim 13, further comprising removing a release liner from the adhesive prior to releasably attaching the electronic circuit to the adhesive.

15. The method of claim 13, wherein releasably attaching the electronic circuit to the adhesive comprises releasably attaching the electronic circuit to the adhesive position at a first end of the installation handle.

16. The method of claim 12, further comprising removing an existing electronic circuit from the surface of the imaging cartridge prior to positioning the electronic circuit on the surface of the imaging cartridge.

17. The method of claim 12, wherein securing the electronic circuit to the surface of the imaging cartridge comprises removing the installation handle from the electronic circuit such that the adhesive is transferred from the installation handle to the electronic circuit.

18. The method of claim 17, wherein securing the electronic circuit to the surface of the imaging cartridge comprises applying a force to the electronic circuit, thereby pressing the adhesive into contact with both the electronic circuit and the surface of the imaging cartridge.

19. The method of claim 12, wherein using the installation handle to position the electronic circuit on the surface of the imaging cartridge comprises holding the installation handle by an adhesive-free end spaced apart from the adhesive, and directing the electronic circuit to a position on the surface of the imaging cartridge.

20. A method for remanufacturing an imaging cartridge, comprising:

providing the imaging cartridge comprising an existing electronic circuit secured to a surface of the imaging cartridge;

removing the existing electronic circuit;

releasably attaching a replacement electronic circuit to an installation handle;

using the installation handle to position the replacement electronic circuit on the surface of the imaging cartridge; and securing the replacement electronic circuit to the surface of the imaging cartridge.

21. The method of claim 20, wherein releasably attaching the replacement electronic circuit to the installation handle comprises releasably attaching the replacement electronic circuit to an adhesive on the installation handle.

22. The method of claim 21, further comprising removing a release liner from the adhesive prior to releasably attaching the replacement electronic circuit to the adhesive.

23. The method of claim 20, wherein securing the replacement electronic circuit to the surface of the imaging cartridge comprises removing the installation handle from the replacement electronic circuit such that the adhesive is transferred from the installation handle to the replacement electronic circuit.

24. The method of claim 23, wherein securing the replacement electronic circuit to the surface of the imaging cartridge comprises applying a force to the replacement electronic circuit, thereby pressing the adhesive between the replacement electronic circuit and the surface of the imaging cartridge.

* * * * *